US010429069B2

(12) United States Patent
Gerendas

(10) Patent No.: US 10,429,069 B2
(45) Date of Patent: Oct. 1, 2019

(54) WALL OF A STRUCTURAL COMPONENT, IN PARTICULAR OF GAS TURBINE COMBUSTION CHAMBER WALL, TO BE COOLED BY MEANS OF COOLING AIR

(71) Applicant: Rolls-Royce Deutschland Ltd & Co KG, Blankenfelde-Mahlow (DE)

(72) Inventor: Miklos Gerendas, Am Mellensee (DE)

(73) Assignee: ROLLS-ROYCE DEUTSCHLAND LTD & CO KG, Blankenfelde-Mahlow (DE)

( * ) Notice: Subject to any disclaimer, the term of this patent is extended or adjusted under 35 U.S.C. 154(b) by 396 days.

(21) Appl. No.: 15/380,333

(22) Filed: Dec. 15, 2016

(65) Prior Publication Data

US 2017/0176006 A1 Jun. 22, 2017

(30) Foreign Application Priority Data

Dec. 16, 2015 (DE) ..... 10 2015 225 505

(51) Int. Cl.
*F23R 3/00* (2006.01)
*F23R 3/06* (2006.01)

(52) U.S. Cl.
CPC ..... *F23R 3/005* (2013.01); *F23R 3/002* (2013.01); *F23R 3/06* (2013.01);
(Continued)

(58) Field of Classification Search
CPC .. F23R 3/002; F23R 3/005; F23R 3/06; F23R 2900/00018; F23R 2900/03041;
(Continued)

(56) References Cited

U.S. PATENT DOCUMENTS 680,924 A * 8/1901 Kelly ..... E04G 7/307 403/246
2,510,645 A * 6/1950 McMahan ..... F23R 3/04 432/222

(Continued)

FOREIGN PATENT DOCUMENTS

DE 4116886 12/1991
DE 102013003444 9/2014

(Continued)

OTHER PUBLICATIONS

Office Action dated May 29, 2018 issued by the European Patent Office for counterpart European Patent Application No. 16203765.9.

(Continued)

*Primary Examiner* — Todd E Manahan
*Assistant Examiner* — Todd N Jordan
(74) *Attorney, Agent, or Firm* — Shuttleworth & Ingersoll, PLC; Timothy J. Klima

(57) ABSTRACT

A wall of a structural component to be cooled by means of cooling air with at least one cooling air channel, which at least in its outflow area is arranged so as to be inclined at an angle with respect to the wall inclined, penetrating the wall from the side at which the cooling air is supplied to the thermally loaded side, characterized in that the cooling air channel has a tubular extension on the side where the cooling air is supplied, wherein the tubular extension is arranged at an angle to the surface of the wall and is supported by means of a rib with respect the surface of the wall, and in particular to an inner gas turbine combustion chamber wall with effusion holes.

13 Claims, 8 Drawing Sheets

Figure 1:
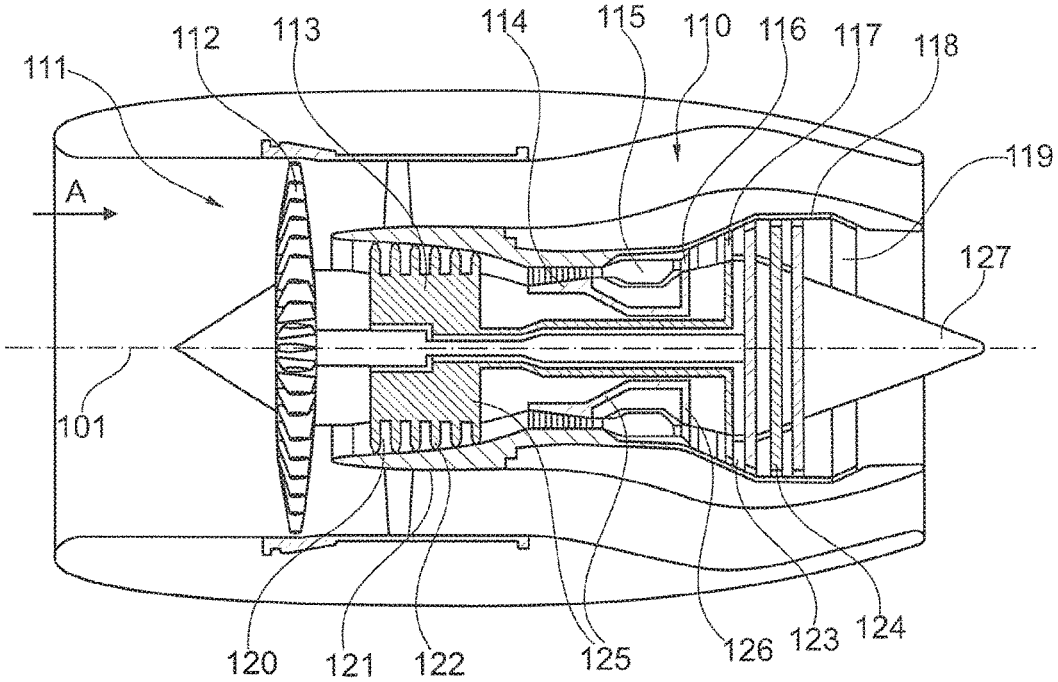

(52) U.S. Cl.
CPC ..... *F23R 2900/00018* (2013.01); *F23R 2900/03041* (2013.01); *F23R 2900/03042* (2013.01); *F23R 2900/03044* (2013.01)

(58) Field of Classification Search
CPC .. F23R 2900/03042; F23R 2900/03043; F23R 2900/03044; F23R 2900/03045
USPC ..... 431/160; 403/199, 245
See application file for complete search history.

(56) References Cited

U.S. PATENT DOCUMENTS

| | | | | |
|---|---|---|---|---|
| 4,132,066 | A * | 1/1979 | Austin, Jr. | F23R 3/06 60/752 |
| 5,209,067 | A * | 5/1993 | Barbier | F23R 3/06 60/757 |
| 5,223,320 | A * | 6/1993 | Richardson | B32B 3/266 428/137 |
| 5,279,127 | A * | 1/1994 | Napoli | F02K 1/822 60/754 |
| 6,029,455 | A * | 2/2000 | Sandelis | F23R 3/002 60/752 |
| 6,675,582 | B2 * | 1/2004 | Monty | F23R 3/08 60/752 |
| 8,887,461 | B2 * | 11/2014 | Hemphill | E04C 3/30 52/296 |
| 9,127,403 | B2 * | 9/2015 | Grogan | D21C 11/00 |
| 9,127,551 | B2 * | 9/2015 | Narcus | F01D 9/023 |
| 9,976,441 | B2 * | 5/2018 | Lacy | F01D 5/189 |
| 2011/0005233 | A1 | 1/2011 | Sadig et al. | |
| 2014/0238030 | A1 * | 8/2014 | Gerendas | F23R 3/002 60/754 |
| 2014/0338347 | A1 * | 11/2014 | Gage | F23R 3/06 60/754 |
| 2015/0128602 | A1 | 5/2015 | Clemen | |
| 2015/0152734 | A1 | 6/2015 | Ceglio et al. | |
| 2015/0260400 | A1 | 9/2015 | Clemen | |
| 2015/0315930 | A1 * | 11/2015 | Koonankeil | F01D 25/12 415/116 |
| 2016/0061451 | A1 * | 3/2016 | Dudebout | F23R 3/06 60/806 |
| 2016/0123592 | A1 * | 5/2016 | Drake | F23R 3/005 60/752 |
| 2017/0009993 | A1 * | 1/2017 | Monahan | F23R 3/286 |

FOREIGN PATENT DOCUMENTS

| | | |
|---|---|---|
| DE | 102013221286 | 4/2015 |
| DE | 102014204472 | 9/2015 |
| EP | 2730844 A1 | 5/2014 |
| EP | 2942487 A1 | 11/2015 |
| WO | 9525932 | 9/1995 |
| WO | 2012134698 | 10/2012 |
| WO | WO2015050592 A2 | 4/2015 |

OTHER PUBLICATIONS

European Search Report dated May 18, 2017 for counterpart European Application No. 16203765.9.
German Search Report dated Dec. 16, 2015 from counterpart German Application No. 10 2015 225 505.0.

* cited by examiner

State of the Art

WALL OF A STRUCTURAL COMPONENT, IN PARTICULAR OF GAS TURBINE COMBUSTION CHAMBER WALL, TO BE COOLED BY MEANS OF COOLING AIR

This application claims priority to German Patent Application 102015225505.0 filed Dec. 16, 2015, the entirety of which is incorporated by reference herein.

The invention relates to a wall of a structural component to be cooled by cooling air as well as to a method for manufacturing a wall, in particular a gas turbine combustion chamber wall.

Specifically, the invention relates to a wall of a structural component which is provided with at least one cooling air channel for cooling by means of cooling air. At least in its outflow area, the cooling air channel is arranged so as to be inclined at an angle to the wall. The wall is impinged by cooling air from one side, and the cooling air flows to the other side of the wall through the cooling air channel. In the process of flowing through the cooling air channel, the cooling air cools the wall and subsequently settles down on the thermally loaded side of the wall as a cooling air film, shielding the same.

Specifically, the invention relates to a gas turbine combustion chamber wall and here in particular to an inner combustion chamber wall that is provided with effusion holes for passing cooling air and for cooling the surface of the hot side of the inner combustion chamber wall.

When it comes to cooling wall elements or walls, it is known from the state of the art to arrange the cooling air channels at an angle in order to increase the effective run length of the cooling air channel. However, this design has limitations, since the angular arrangement of the cooling air channels is only possible up to an angle which still allows for a sufficient through-flow to take place. By way of example, it may be referred to U.S. Pat. No. 5,000,005 A. This printed document shows a gas turbine combustion chamber with effusion holes that are widened in the outflow area and form a diffusor. At that, commonly used angles of inclination of cooling air channels lie within an angle range of between 15° and 45°, as measured between the central axis of the cooling air channel and the surface of the wall.

In order to increase the total length of the cooling air channel it has been suggested to increase the total wall thickness. However, this leads to a considerable increase in weight and has therefore proven to be disadvantageous. In this context, it may be referred to WO 95/25932 A1.

The invention is based on the objective to create a wall of a structural component to be cooled by means of cooling air that ensures an optimized cooling while also being characterized by a simple structure as well as a simple and cost-effective manufacturability.

According to the invention, this objective is achieved by the combination of features herein.

Thus, it is provided according to the invention that the cooling air channel is configured so as to be elongated in a tube-like manner on the side where the cooling air is supplied. Thus, the cooling air channel extends through the wall to be cooled and protrudes in the form of a tubular projection beyond the surface at which the cooling air is supplied. For one thing, this leads to the entire length of the cooling air channel being increased. Thus, the tubular projection forms an additional cooling surface for the cooling air that flows through the cooling air channel, so that a better overall cooling of the wall becomes possible.

Further, the tubular extension according to the invention leads to an enlarged outer surface, namely that of the tubular projection, being created, which is also used for heat transfer, since the cooling air flows around it.

In order to be able to fulfill the task of heat transfer even more efficiently, the tubular extension is connected by means of a rib to the wall which is exposed to the hot gas, so that the heat transfer from the wall into the tubular extension can also be effected through the rib. In this manner, the temperature of the tubular extension is increased and thus the cooling effect of the entire system is improved. Further, the tubular extension is arranged at an angle to the surface of the wall. The rib supports the tubular extension with respect to the surface of the wall. The angle at which the tubular extension is arranged with respect to the surface of the wall is preferably an acute angle, in particular lying within an angle range of between 15° and 45°. Further, it is preferred that a maximum width of the tubular extension of the cooling air channel is greater than a maximum width of the rib. Preferably, the width of the rib is constant. Alternatively, the rib has a greater width at the base area, with which the rib is arranged at the wall, than at a connection area to the tubular extension of the cooling air channel.

An additional effect improving the cooling is that the tubular projection, which projects beyond the surface of the side of the wall, leads to the creation of turbulences of the cooling air. The heat transfer coefficient is improved due to this fact, as well.

In total, the tubular projections or extensions can have a relatively small volume, so that the overall total weight of the wall becomes only insignificantly higher. This turns out to be advantageous in particular for structural components the weight of which is to be minimized.

A particularly advantageous application of the solution according to the invention can be realized for inner hot combustion chamber walls of the combustion chambers of gas turbines. But also other wall elements that are to be cooled by means of cooling air can be developed further according to the invention, such as for example walls of turbine blades/vanes that are cooled through cooling air channels in the interior space of the turbine blades/vanes.

In an advantageous further development of the invention it is provided that a part of the flow length of the cooling air channel is embodied as a diffusor that extends substantially through the entire thickness of the wall. In the solutions known form the state of the art, only a small length of the cooling air channel can be used as a diffusor, since the diffusor length is limited by the wall thickness. Thanks to the tubular projections, a possibility is created according to the invention to considerably increase the effective length of the diffusor, wherein the diffusor can not only be embodied across the entire thickness of the wall, but in addition also across a partial area of the tubular projection.

The tubular projection of the wall provided according to the invention can be manufactured in different ways. If the wall is manufactured as a cast part, the entire cooling air channel—including the area in which it extends through the tubular projection or the tubular extension—has a linear extension with a straight axis. At that, the tubular extension can be formed in a slightly conical manner, so as to have a draft angle that is suitable for casting processes. Here, the cooling air channel can be created by means of laser or by means of spark erosion. The rib between the wall and the tubular extension increases the stability of the wax model for a cast in the lost mold, and it also improves the filling of the tubular extension during the actual casting procedure.

The support of the tubular extension by means of a rib is also helpful when the wall according to the invention or the structural component provided with the wall is manufactured in a generative manner (laser deposition welding, or the like). The rib renders the structure of the geometry optimized with respect to production-technical aspects, since no free-standing parts are present and therefore no support constructions need to be provided that have to be subsequently removed. According to the invention, first a part of the rib and only subsequently the tubular extension together with the rest of the rib are produced in the course of the generative manufacturing process. In a wall that is manufactured in such a way, it is also possible to bent the cooling air channel, for example in an arc-shaped manner. This means that the cooling air channel has a larger angle at the side of the cooling air supply towards the surrounding surface than in the exit area at the thermally loaded side of the wall. Here, the orientation of the rib results from the direction of the generative construction, i.e. substantially perpendicular to the base plate on which the individual layers are generated during the generative manufacture, and it does not deviate from this direction by more than ±30° according to the invention. However, the direction of the curvature of the cooling air channel results from the requirements for the cooling of structural components. Close to the combustion chamber head or in front/behind wall apertures such as mixing air holes or access holes for spark plugs, it can be expedient if the exit of the cooling air channel has a different angle to the axis of the engine than the entry, for example 30° at the entry and 45° at the exit, so that the cooling air channel can be guided around such wall apertures. Overall it can therefore be advantageous if the rib and the cooling air channel have two different alignments.

Preferably, a central axis of the cooling air channel and a rib central axis of the rib are provided in such a manner that they lie within a common plane. In this way, the tubular extension is located rectilinearly above the rib.

Alternatively, according to a further preferred exemplary embodiment of the invention, the central axis of the cooling air channel and the rib central axis of the rib are provided in such a manner that the two central axes are arranged at an acute angle to each other. The angle preferably lies between 15° and 45°, and in a particularly preferred case is 30°.

It is further preferred if the wall comprises an obstacle, in particular an opening, such as for example a mixing air hole or an access hole for a spark plug, wherein a plurality of cooling air channels with ribs is arranged along the circumference of the obstacle. In particular if the central axes of the cooling air channel and the rib intersect, a cooling flow surrounding the obstacle can be obtained at the thermally loaded side of the wall by means of the arrangement of a plurality of cooling air channels.

It is further preferred if the central axis of the cooling air channel is oriented in parallel to a flow that is present at the thermally loaded side of the wall. This results in an enhanced cooling of the thermally loaded wall.

According to the invention, the inflow area of the tubular extension of the cooling air channel can further be configured in a flow-optimized manner. It can be designed to be either sharp-edged, to have a chamfer or to be rounded.

When used in an inner combustion chamber wall, the cross-section of the cooling air channel can have any shape according to the invention, for example it can be circular, elliptical or have the shape of an elongate hole. In the latter case, the cooling air channel can be dimensioned so as to be 0.5 mm×1.8 mm in size, for example.

As has already been mentioned, the tubular extension of the cooling air channel in connection with the rib leads to additional turbulences in the inflowing cooling air and thus results in an improved heat transfer.

If the wall designed according to the invention is used in a double-walled gas turbine combustion chamber, the length of the tubular extension or of the tubular projection of the cooling air channel is dimensioned in such a manner that the latter serves as a spacer to the outer combustion chamber wall. Accordingly, the orientation of the surface that is formed by the inflow area perpendicular to the central axis of the cooling air channel is chosen in such a manner that it is not perpendicular to the surface of the side of the cooling air supply of the wall. In the event of contact with an outer combustion chamber wall, this would lead to wear to the inflow area. Thus, an angular arrangement is provided which for example extends only up to approximately 45°. This facilitates a sufficiently large inflow area even in the vent of contact with the outer combustion chamber wall. The orientation of the surface through which the cooling air flows into the cooling air channel is determined by the respectively used manufacturing method. This, too, leads to the cooling air channel not being arranged in a perpendicular manner on the surface of the side of the cooling air supply of the wall. In the case of a cast part, the orientation is determined by the draft angle. In the case of a generative manufacture, the orientation of the surface is determined by the capacity of the respective generative method to create overhanging structures without an additional support structure, since an additional support structure would subsequently have to be removed in a work-intensive manner.

If the wall according to the invention is used as an inner combustion chamber wall of a double-walled gas turbine combustion chamber, it may happen that an obstacle, such as for example a mixing air hole or a front shingle edge, for example in the direction to a combustion chamber head, is positioned in the inflow area of the tubular extension of the cooling air channel. As has already been indicated above, in this case it is possible according to the invention to design the tubular extension in an arc-shaped or more strongly bent manner. In this case, the total height of the tubular extension would be lower than the distance between the inner and the outer combustion chamber wall. What would thus result would be a distance that corresponds to 0.5 to 2 times the hydraulic diameter of the cooling air channel. In this manner, it is avoided that the inflow area of the tubular extension is blocked in the event of thermal warping, because the inner combustion chamber wall would come into contact with the outer combustion chamber wall at the edge of the mixing air hole or at the shingle edge. In any case, the inflow area for the cooling air into the cooling air channel remains open.

With respect to the possibility of forming a diffuser in the wall, thus the option is created according to the invention to let the diffusor begin at a greater distance from the thermally loaded side of the wall. With the opening angle of the diffusor remaining the same, what thus results is a considerable extension of the diffusor as compared to the state of the art, without the cooling air flow rate having to be increased.

As follows from the above description, the invention is characterized by a series of considerable advantages:

Through the tubular extension of the cooling air channel, the inner surface of the cooling air channel is enlarged, resulting in an increased heat transfer.

In addition, the surface of the side of the wall on which the cooling air supply occurs is also enlarged through the tubular extension. If the wall according to the invention is used in a gas turbine combustion chamber, this surface is usually cooled through impingement cooling. Through the enlargement of the surface, more heat is absorbed by the cooling air, so that the overall temperature of the wall can be lowered.

The tubular extension leads to an increase of the degree of turbulence in the flow inside the impingement cooling cavity, namely in the intermediate space between the outer and the inner combustion chamber wall, in which cooling air is supplied through the impingement cooling holes of the outer combustion chamber wall. This, too, leads to increased heat transfer.

Thanks to the possibility created according to the invention to increase the effective length of the diffusor and to open it further at its exit area with the opening angle remaining the same, the flow velocity of the cooling air that is flowing through the cooling air channel is lowered. Through the lower flow velocity of the cooling air, the film cooling effect is increased.

Through the rib, by means of which the tubular extension is supported at the wall at the surface of the side of the cooling air supply, additional heat is dissipated from the wall and introduced into the tubular extension. From here, it can be emitted inward into the elongated cooling air channel and also outward from the tubular extension to the surrounding air. An additional cooling of the wall results due to the fact that the cooling air flows around the rib.

If the wall according to the invention is used in a double-walled gas turbine combustion chamber, the tubular projection ensured that a distance between the outer and the inner combustion chamber wall is maintained. In this manner it is ensured that even in the event of thermal warping, in particular of the inner combustion chamber wall, the impingement cooling can take place unobstructed through the impingement cooling holes of the outer combustion chamber wall, since any blocking of the impingement cooling holes is avoided. Thus, the cooling air can flow unobstructed through the impingement cooling holes into the intermediate area between the outer and the inner combustion chamber wall.

The rib creates the advantage that the wall according to the invention can be manufactured with a preferred geometry, be it as a cast part or by using a generative method, with the heat being conducted around it from the thermally loaded wall into the tubular extension and from there being released into the air.

A flow optimization, for example a notable smoothing of the inflow area of the tubular projection, ensures that the flow moves along the entire inner wall of the cooling air channel, creating a good heat transfer.

Further, the invention relates to an additive method for manufacturing a wall of a structural component to be cooled by means of cooling air with at least one cooling air channel having a tubular extension that is arranged at an angle to the surface of the wall and is supported by means of a rib with respect to the surface of the wall, wherein the additive method is designed in such a manner that the cooling air channel and the rib are manufactured in an additive manner, namely in such a way that the rib provides a support of the cooling air channel during the manufacturing process.

Figure 2:
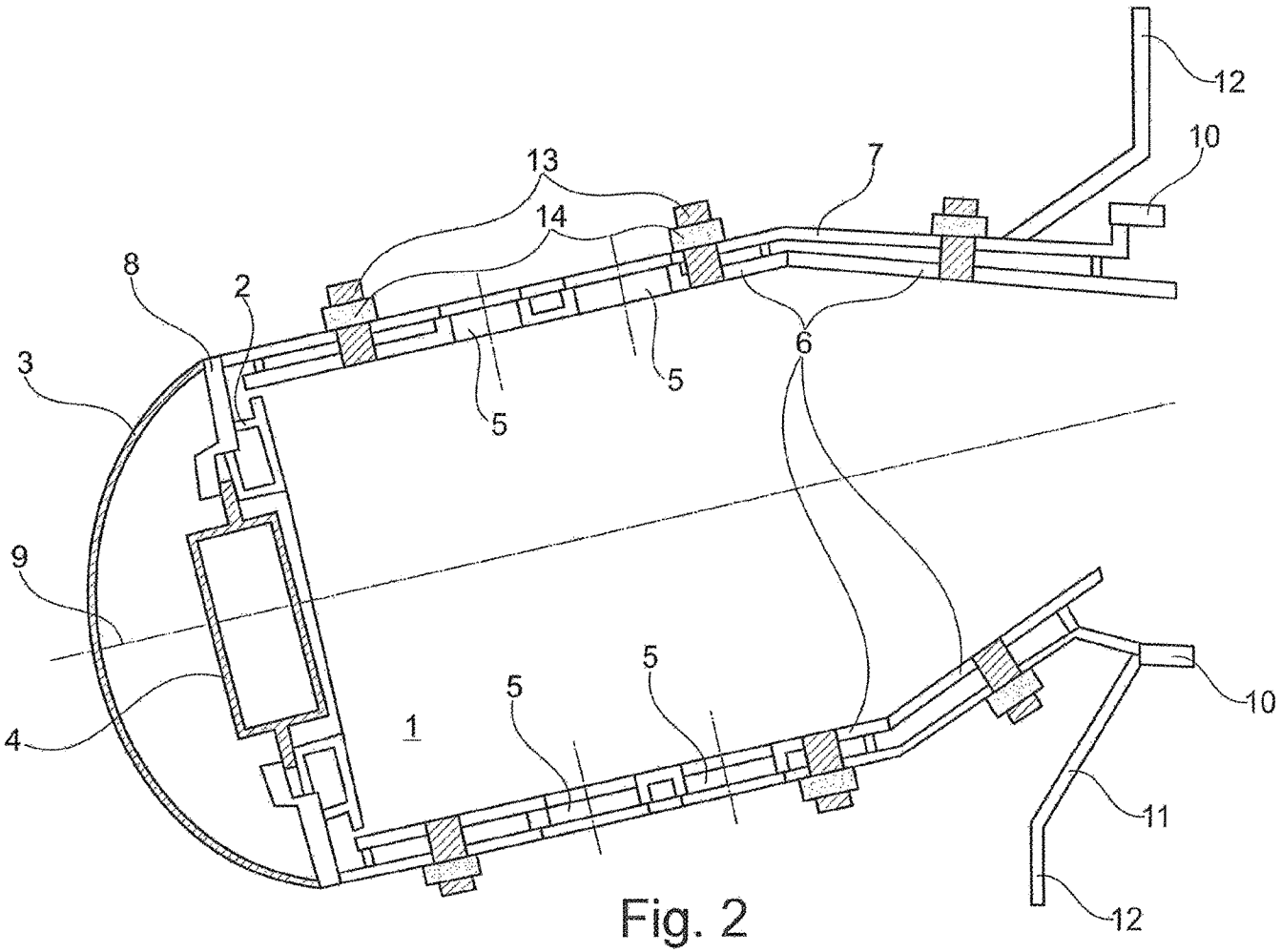
Figure 3:
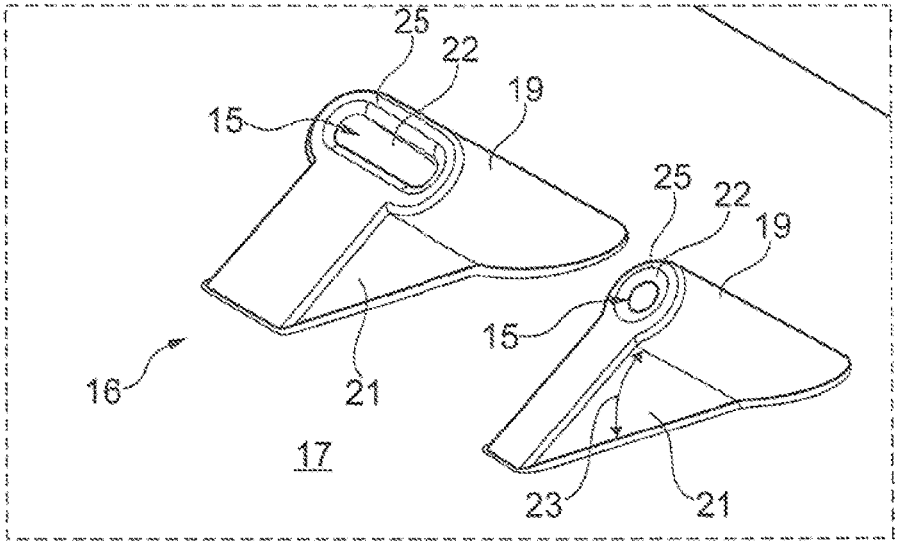
Figure 4:
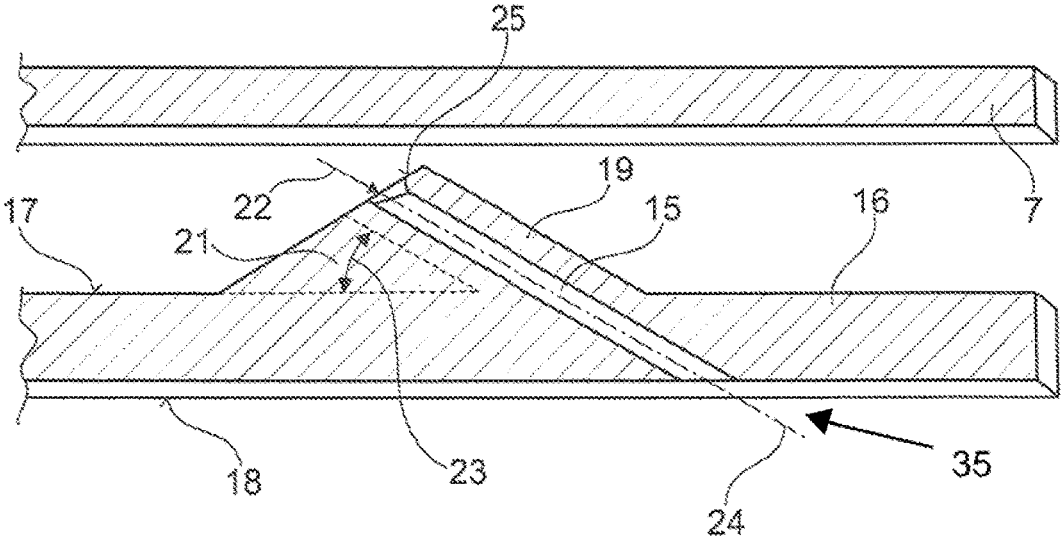
Figure 5:
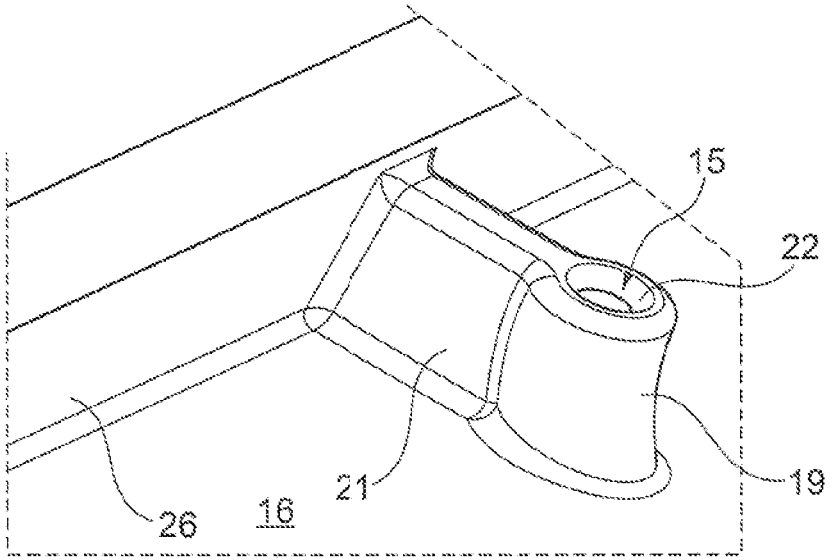
Figure 6:
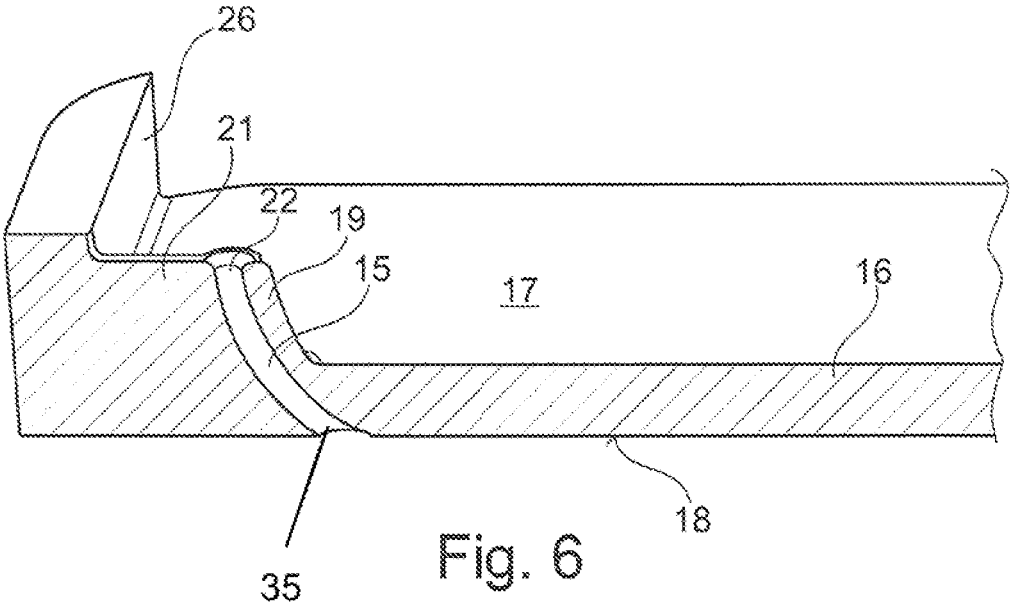
Figure 7:
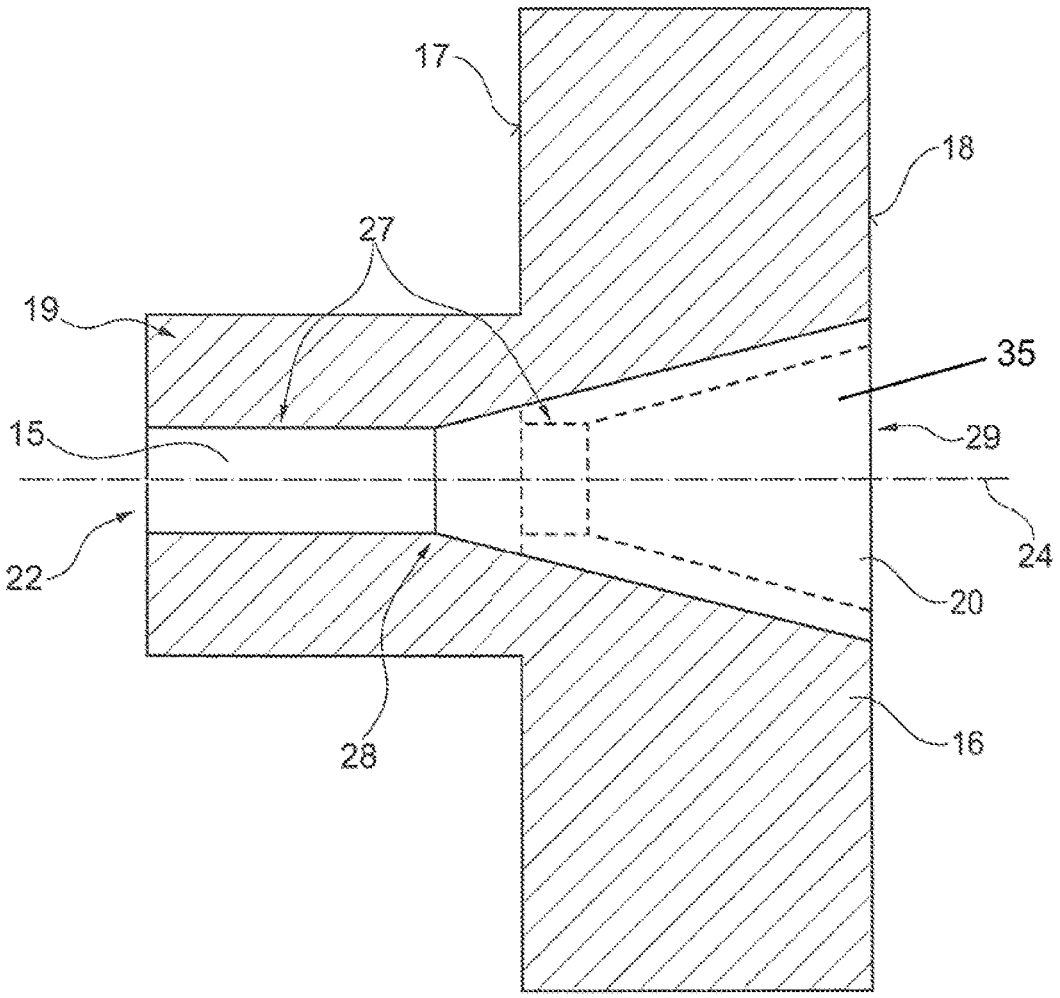
Figure 8:
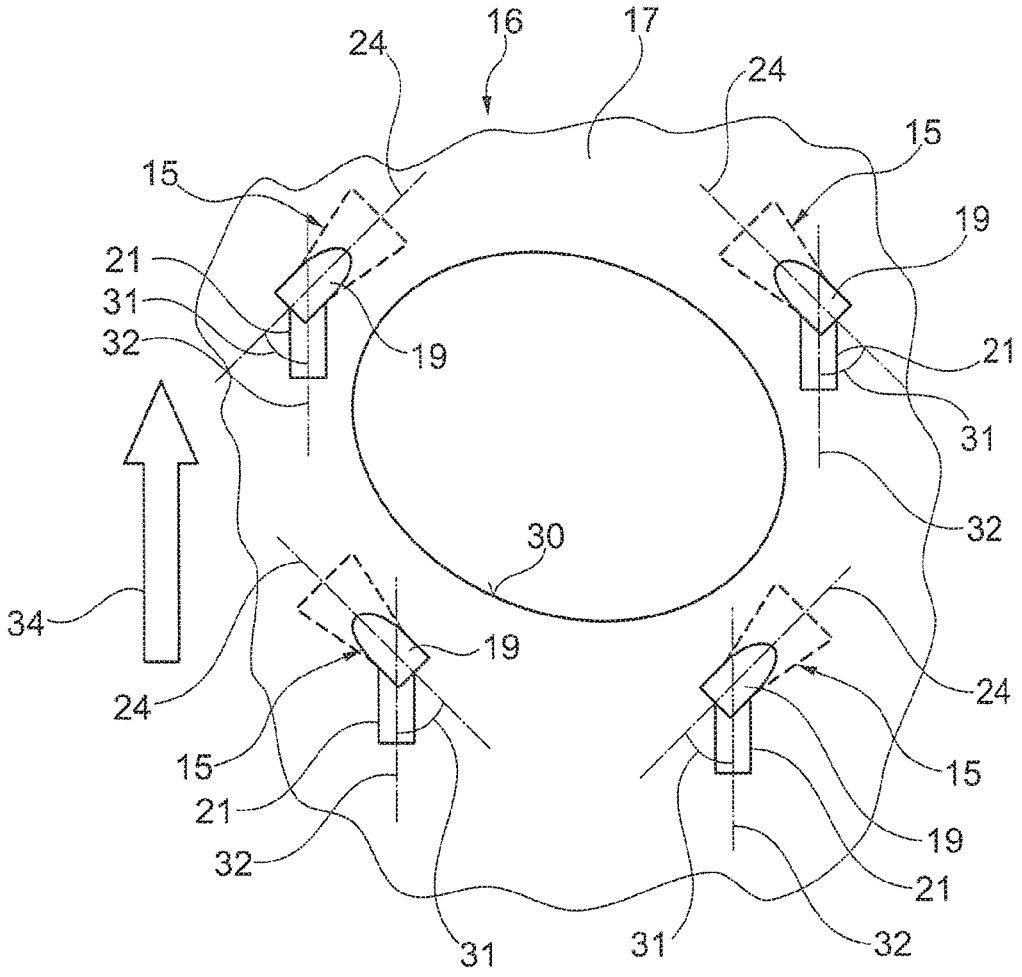
Figure 9:
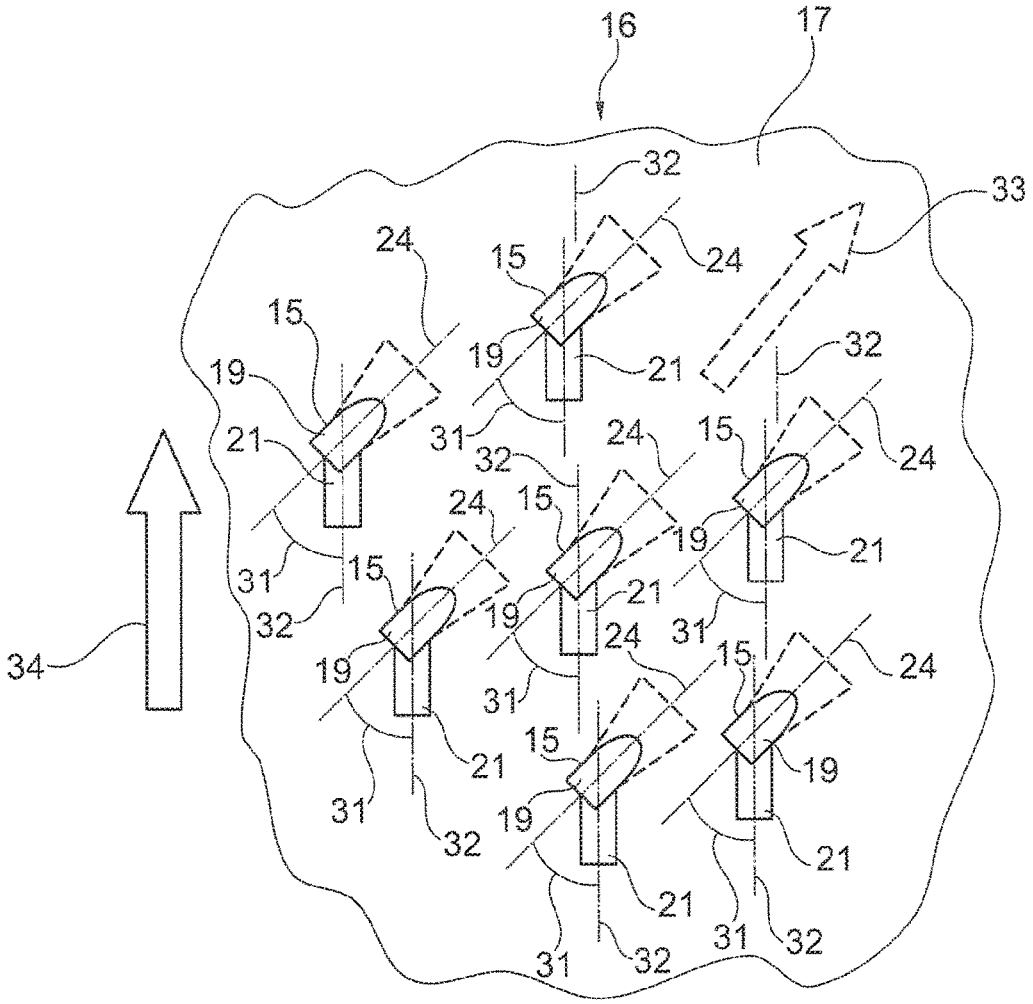

In the following, the invention is explained based on the exemplary embodiments in connection with the drawing. Herein:

FIG. 1 shows a schematic rendering of a gas turbine engine according to the present invention, FIG. 2 shows a longitudinal sectional view of a combustion chamber according to the state of the art, FIG. 3 shows a perspective partial view of two design variants of the wall according to the invention with cooling air channels that are extended in a tube-like manner, FIG. 4 shows a simplified sectional view that is analogous to FIG. 3, FIG. 5 shows a perspective view of further design variant of the invention, FIG. 6 shows a simplified sectional view that is analogous to FIG. 5, FIG. 7 shows a further sectional view of a design variant for embodying a diffusor, FIG. 8 shows a top view of a further design variant of a wall with an obstacle, FIG. 9 shows a top view of a further design variant, and FIGS. 10*a*-10*f* show schematic renderings of an additive method for manufacturing a wall of a structural component according to the invention.

The gas turbine engine 110 according to FIG. 1 represents a general example of a turbomachine in which the invention may be used. The engine 110 is configured in a conventional manner and comprises, arranged successively in flow direction, an air inlet 111, a fan 112 that rotates inside a housing, a medium-pressure compressor 113, a high-pressure compressor 114, a combustion chamber 115, a high-pressure turbine 116, a medium-pressure turbine 117 and a low-pressure turbine 118 as well as an exhaust nozzle 119, which are all arranged around a central engine axis 1.

The medium-pressure compressor 113 and the high-pressure compressor 114 respectively comprise multiple stages, of which each has an arrangement of fixedly arranged stationary guide vanes 120 that are generally referred to as stator vanes and project radially inward from the core engine shroud 121 through the compressors 113, 114 into a ring-shaped flow channel. Further, the compressors have an arrangement of compressor rotor blades 122 that project radially outward from a rotatable drum or disc 125, and are coupled to hubs 126 of the high-pressure turbine 116 or the medium-pressure turbine 117.

The turbine sections 116, 117, 118 have similar stages, comprising an arrangement of stationary guide vanes 123 projecting radially inward from the housing 121 through the turbines 116, 117, 118 into the ring-shaped flow channel, and a subsequent arrangement of turbine blades/vanes 124 projecting outwards from the rotatable hub 126. During operation, the compressor drum or compressor disc 125 and the blades 122 arranged thereon as well as the turbine rotor hub 126 and the turbine rotor blades/vanes 124 arranged thereon rotate around the engine axis 101.

FIG. 2 shows a longitudinal section view of a combustion chamber wall as it is known from the state of the art in an enlarged view. At that, a combustion chamber 1 with a central axis 9 is shown, comprising a combustion chamber head 3, a base plate 8 and a heat shield 2. A burner seal is identified by the reference sign 4. The combustion chamber 1 has an outer cold combustion chamber wall 7 at which an inner hot combustion chamber wall 6 is attached. Mixing air holes 5 are provided for supplying mixing air. With view to clarity, impingement cooling holes and effusion holes are omitted.

The inner combustion chamber wall 6 is provided with bolts 13 that are embodied as threaded bolts and are screwed on by means of nuts 14. The combustion chamber 1 is mounted by means of combustion chamber flanges 12 and combustion chamber suspensions 11. The reference sign 10 identifies a sealing lip.

FIG. 3 shows a perspective partial view of embodiment variants of the wall 16 according to the invention. Cooling air channels 15 that function as effusion holes are formed at the wall. As shown in the right half of the image of FIG. 3, they can have a circular cross-section or, as shown in the left half of the image, can have an elongated cross-section. The reference sign 22 indicates an inflow area of the respective cooling air channel 15 and 35 indicates an outflow area of the cooling air channel 15. As follows from the illustrations of FIG. 3, the cooling air channels 15 are configured so as to be elongated in a tube-like manner. The tubular extensions 19 are inclined at an angle 23 to the surface of one side 17 of the wall 16 onto which cooling air impinges. The tubular extensions 19 are respectively supported by means of a rib 21. For one thing, the rib 21 serves for simplifying manufacture of the wall according to the invention. For another thing, the rib 21 forms an additional surface, in addition to the surface of the tubular extension 19, around which cooling air flows so that it forms a heat transfer surface. Thanks to the rounded, streamlined design of the inflow area 22, an improved inflow into the cooling air channels 15 is realized.

FIG. 4 shows a simplified sectional view of the exemplary embodiment of FIG. 3 through one of the tubular extensions 19. As a result, a central axis 24 of the cooling air channel 15, which in this exemplary embodiment is designed in a linear manner, is inclined at an angle 23 to the surface of the side 17 of the wall 16. This angle can be between 15° and 45°. For purposes of simplification, the angle 23 between the side 17 and the outer contour of the tubular extension 19, which is indicated by dashed lines, is drawn in in FIG. 4.

Further, FIG. 4 shows an outer combustion chamber wall 7 parallel to the wall 16. The former has a clearance to the wall 16 forming an inner combustion chamber wall (see FIG. 2), in which cooling air is introduced through impingement cooling holes that are not shown. In addition, the tubular extension 19 forms a spacer between the wall 16 and the combustion chamber wall 7. Thus, in the event of thermal warping of the wall 16, it is always ensured that a sufficient volume for passing cooling air is maintained.

The inflow area 22 of the tubular extension 19 forms a surface 25 which is inclined at an angle to the surface of the side 17 of the wall 16. Even if a contact would occur between the combustion chamber wall 7 and the tubular extension 19, the inflow area 22 of the cooling air channel 15 would still remain unobstructed, so than an inflow of cooling air into the cooling air channel is ensured.

FIG. 4 shows a thermally loaded side of the wall 16 indicated by the reference sign 18. In the following, this is explained in detail in connection to FIG. 4.

FIGS. 5 and 6 show a design variant of the tubular extension 19, in which the tubular extension 19 is arranged substantially in parallel to the side 17 of the wall 16 in its inflow area. This design variant is preferably chosen in the case that the cooling air channel 15 is configured so as to be adjoining an edge 26, for example a shingle edge or the edge of a mixing air hole 5. A linear cooling air channel 15, as shown in FIG. 4, would not lead to an optimal inflow of cooling air. For this reason, in the exemplary embodiment of FIGS. 5 and 6, the entire cooling air channel 15 is formed in a bent manner. It is to be understood that the height of the tubular extension 19 is lower than the height of the edge 26, so that no blocking of the inflow area 22 occurs even in the event of a direct contact of the wall 16 to the combustion chamber wall 7 (see FIG. 4), which is not shown here.

Also in the exemplary embodiment of FIGS. 5 and 6, the inflow area 22 is configured in a rounded and flow-optimized manner, just like in the previous exemplary embodiment.

FIG. 7 shows a sectional view through the wall according to the invention, for example according to the exemplary embodiment of FIG. 4. Here, the sectional direction is chosen in such a manner that a diffusor 20 is shown, which opens towards the thermally loaded side 18 of the wall 16. In the sectional view of FIG. 7, the tubular extension 19 can be seen. It is to be understood that, with a view to a clearer illustration, the wall thickness relationships are not to scale. The reference sign 27 indicates the effective cross-section of the cooling air channel 15 with the left arrow. The diffusor 20 begins in the area of the reference sign 28 after a predetermined run length of the cooling air channel 15 in the tubular extension 19, as indicated by the solid lines. As can be seen from the illustration, the offset beginning of the diffusor 20 leads to a larger opening and thus to a larger cross-section 29 of the cooling air channel exit while the diffusor angle remains the same (with respect to the central axis 24 of the cooling air channel 15).

By way of comparison, FIG. 7 shows the situation of the state of the art with dashed lines. Without the tubular extension 19 according to the invention it would be necessary to maintain the cross-section 27 of a shortened cooling air channel across a part of the thickness of the wall 16. Here, the beginning of the diffusor would be offset backwards in the direction of the thermally loaded side 18, whereby a considerably smaller cross-section 29 is created in the area of the cooling air exit of the cooling air channel 15.

FIG. 8 shows a further design variant of the invention in which an obstacle 30, for example a mixing air hole, is provided in the wall 16. A plurality of cooling air channels 15 is arranged at the side 17 of the cooling air supply along the circumference of the obstacle. As can be seen in FIG. 8, a central axis 24 of the cooling air channels 15 is arranged at an acute angle 31 to a rib central axis 32. As can be seen from FIG. 8, the arrangement of the cooling air channels 15 along the circumference of the obstacle 30 facilitates sufficient cooling at the thermally loaded side along the circumference of the obstacle. At that, the cooling air channels 15 are respectively embodied with one tubular extension and one diffusor and are only shown schematically in FIG. 8.

FIG. 9 shows a further design of the present invention, wherein a plurality of cooling air channels 15 is provided. Like in the exemplary embodiment shown in FIG. 8, the central axes 24 of the cooling air channels 15 are arranged at an acute angle 31 to the rib central axis 32. As can be seen in FIG. 9, an alignment of the cooling air channels 15 is designed in such a way that they are parallel to a flow 33 at the thermally loaded side, which is indicated in FIG. 9 by the dashed arrow (flow 33). In this manner, a particularly good cooling of the thermally loaded side 18 of the wall 16 is achieved.

Figure 10A:
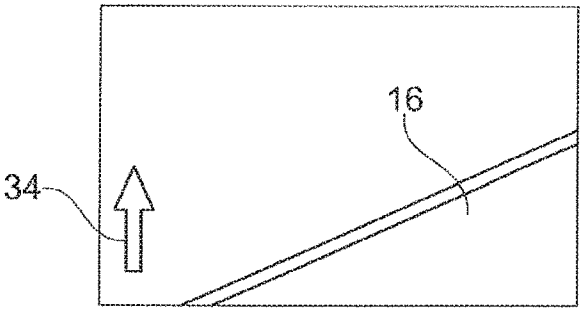
Figure 10B:
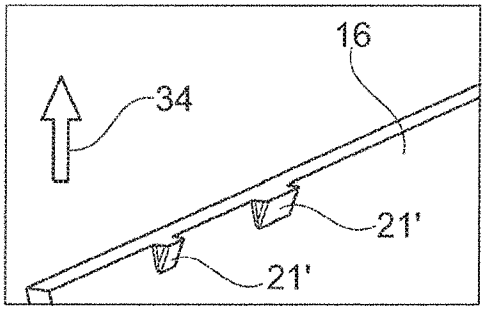
Figure 10C:
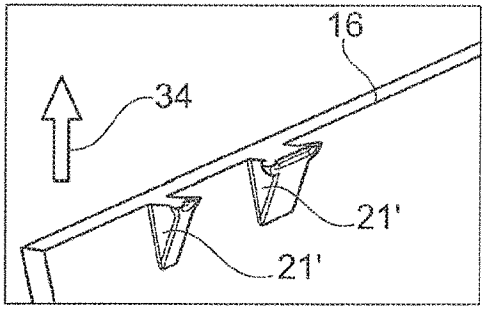
Figure 10D:
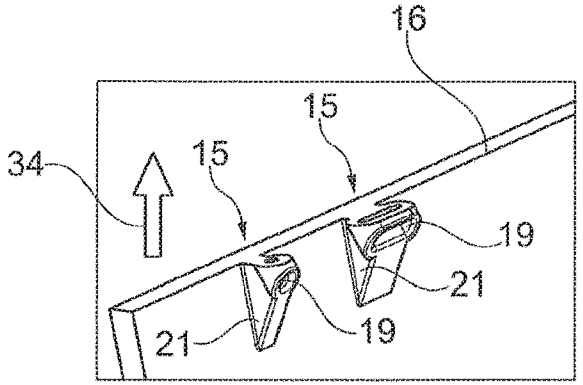
Figure 10E:
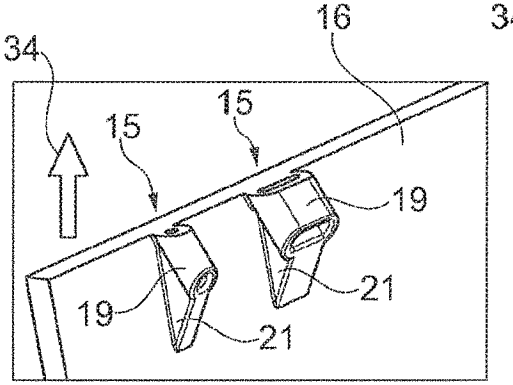
Figure 10F:
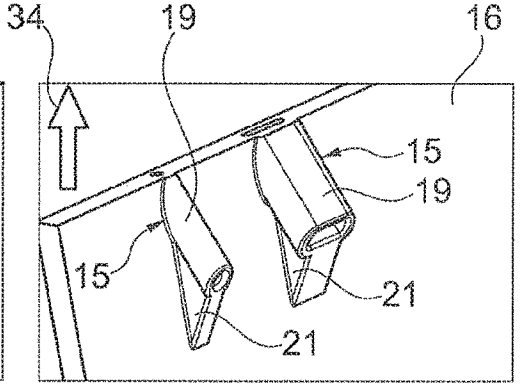

FIGS. 10*a* to 10*f* show an example of a manufacture of a wall of a structural component according to the invention. In this exemplary embodiment, the structural component is a combustion chamber wall. The method is an additive method, wherein the arrow 34 indicates a build-up direction of the additive method. As can be seen from FIG. 10*a*, first the wall 16 is constructed in an additive manner. FIG. 10*b* shows how the beginnings of the ribs 21' are constructed. In FIG. 10*c*, the ribs 21 are constructed up to the beginning of the cooling air channel 15, with FIG. 10*c* already showing the beginning of the structure of the cooling air channel 15. As FIG. 10*d* shows, the cooling air channels are slowly created as the construction in the build-up direction 34 progresses, wherein the cooling air channels are supported at the rib 21. The further formation of the cooling air channels can be seen in FIGS. 10*e* and 10*f*. As can be seen from FIGS. 10*a* to 10*f*, a vertical manufacture of the structural component in the build-up direction 34 can thus be facilitated by means of an additive method. The structure of the rib 21 supports the cooling channel 15. In this exemplary embodiment, the tubular extension 19 of the cooling air channel 15 extends on the rib 21 in a linear manner. Like in FIG. 3, in FIGS. 10*a* to 10*f* two embodiment variants with different cross-sections of the cooling air channel are shown in an exemplary manner. If the central axis of the cooling air channel 15 and the rib central axis 32 intersect, as shown in FIGS. 8 and 9, the build-up direction 34 is parallel to the rib central axis 32. This is drawn in in a schematic manner in FIGS. 8 and 9.

PARTS LIST

1 combustion chamber
2 heat shield
3 combustion chamber head
4 burner seal
5 mixing air hole
6 inner hot combustion chamber wall/segment/shingle
7 outer cold combustion chamber wall
8 base plate
9 central axis
10 sealing lip
11 combustion chamber suspension
12 combustion chamber flange
13 bolt
14 nut
15 effusion hole/cooling air channel
16 wall
17 side of the cooling air supply
18 thermally loaded side
19 tubular extension
20 diffusor
21 rib
22 inflow area
23 angle
24 central axis
25 surface
26 edge
27 cross-section
28 beginning of diffusor
29 cross-section
31 obstacle/mixing air hole/access hole
31 acute angle
32 rib central axis
33 flow at the thermally loaded side
34 build-up direction of the additive method
101 engine central axis
110 gas turbine engine/core engine
111 air inlet
112 fan
113 medium-pressure compressor (compactor)
114 high-pressure compressor
115 combustion chamber
116 high-pressure turbine
117 medium-pressure turbine
118 low-pressure turbine
119 exhaust nozzle
120 guide vanes
121 engine cowling
122 compressor rotor blades
123 guide vanes
124 turbine blades/vanes
125 compressor drum or compressor disc
126 turbine rotor hub
127 outlet cone

The invention claimed is:

1. A wall of a structural component to be cooled, comprising:

a first side with a tubular extension projecting outward from the first side, wherein the tubular extension has an inflow area, and a thermally loaded second side with an outflow area, wherein the thermally loaded second side is opposite the first side;

at least one cooling aft channel arranged so as to be inclined at an angle to the wall, and extending from the inflow area to the outflow area through the tubular extension, wherein the cooling air channel penetrates from the first side to the thermally loaded second side to supply a cooling aft from the inflow area to the outflow area; and a rib connecting the tubular extension to the first side, wherein the tubular extension is supported by the rib with respect to a surface of the first side.

2. The wall according to claim 1, wherein a length of the cooling air channel is configured as a diffusor that extends through the wall.

3. The wall according to claim 1, wherein an outer surface of the tubular extension is at least partly conical.

4. The wall according to claim 1, wherein the cooling air channel includes a linear or arc-shaped path.

5. The wall according to claim 1, wherein the inflow area at the cooling air channel comprises at least one chosen from a sharp edge, a chamfered edge and a rounded edge.

6. The wall according to claim 1, wherein the wall is configured as a cast part.

7. The wall according to claim 1, wherein the wall is configured as a structural component that is manufactured in an additive manner.

8. The wall according to claim 1, wherein a central axis of the cooling air channel and a rib central axis of the rib are located in a common plane.

9. The wall according to claim 1, wherein a central axis of the cooling air channel is arranged at an acute angle to a central axis of the rib.

10. The wall according to claim 9, further comprising one chosen from an obstacle and an opening, wherein a plurality of cooling air channels with ribs is arranged along a circumference of the one chosen from an obstacle and an opening.

11. The wall according to claim 9, wherein the central axis of the cooling air channel is arranged in parallel to a flow at the thermally loaded second side.

12. A gas turbine combustion chamber wall that includes:

an outer combustion chamber wall; and an inner combustion chamber wall configured according to claim 1, wherein the inner combustion chamber wall is mounted to the outer combustion chamber wall at a distance, and the inner combustion chamber wall has a plurality of cooling air channels that are arranged so as to be inclined with respect to the inner combustion chamber wall.

13. A method for manufacturing a wall of a structural component comprising:

providing;

a first side with a tubular extension projecting outward from the first side, wherein the tubular extension has an inflow area, and a thermally loaded second side with an outflow area, wherein the thermally loaded second side is opposite the first side;

at least one cooling air channel arranged so as to be inclined at an angle to the wall, and extending from the inflow area to the outflow area through the tubular extension, wherein the cooling air channel penetrates from the first side to the thermally loaded second side to supply a cooling air from the inflow area to the outflow area; and a rib connecting the tubular extension to the first side, wherein the tubular extension is supported by the rib with respect to a surface of the first side, and manufacturing the cooling air channel and the rib by an additive method.

* * * * *